United States Patent [19]

Hwang et al.

[11] Patent Number: 4,757,986

[45] Date of Patent: Jul. 19, 1988

[54] STRUCTURAL IMPROVEMENT OF MOTION TYPE SOLID WATER BALL

[76] Inventors: Shi-Geng Hwang; Ming-Guei Tsay, both of No. 51, Lung 85 Lane 17, Sec. 1, Yan-Ping Rd., Shin-Chu City, Taiwan

[21] Appl. No.: 943,740

[22] Filed: Dec. 19, 1986

[51] Int. Cl.[4] ..... A63H 13/20; A63H 13/26; G09F 19/00

[52] U.S. Cl. ..... 272/31 R; 446/136; 40/426

[58] Field of Search ..... 446/133–136, 446/242, 267, 485, 298, 418, 73, 74, 173, 252, 266, 197; 248/69, 74.1; 403/230; 40/426; 272/31 R

[56] References Cited

U.S. PATENT DOCUMENTS

| | | | |
|---|---|---|---|
| 1,485,641 | 3/1924 | Sparks | 446/485 |
| 2,323,837 | 7/1943 | Neal | 446/136 |
| 2,544,949 | 3/1951 | Daniel | 446/153 |
| 3,006,111 | 10/1961 | Koch | 446/136 |
| 3,295,252 | 1/1967 | Willette | 446/267 |
| 3,526,934 | 9/1970 | Owen, Sr. | 248/71 |
| 4,552,542 | 11/1985 | Reysman | 446/242 |

*Primary Examiner*—Robert A. Hafer
*Assistant Examiner*—Charles H. Sam
*Attorney, Agent, or Firm*—Morton J. Rosenberg

[57] ABSTRACT

This invention relates to a kind of the structural improvement of the motion type solid water ball. The major improvement is to place permanent magnets respectively on the upper movable plate and the lower fixed plate in a form of combination arrangement. The center of lower fixed plate is fixed on the driving pole of the musical bell; and the upper movable plate is mounted on a movable plate with a rotuberant pillar standing in its center. The main characters are: when the switch of the musical bell is start out, delightful musical rhythm is sounded so that its drivingpole starts out drive the lower fixed plate to turn around in circular movement; then, the permanent magnets fixed on the upper part of the ower fixed plate drives the permanent magnets fixed on the lower part of the upper movable plate, which in combination arrangement, thus enabling the doll or flowers and tree fixed on the movable plate to turn round and round in solid circular movement so that the water ball can play in various figures, giving a life-like effect.

7 Claims, 3 Drawing Sheets

STRUCTURAL IMPROVEMENT OF MOTION TYPE SOLID WATER BALL

BACKGROUND OF THE INVENTION

As the present conventional water balls, the fixed toys are placed in the water ball after the water is poured in. Its overall appearance gives a wooden and dull feeling, without an effect of active pleasures of life. Besides, as the toys are fixed in a standing position by coating gums on the bottom of the toys; in such arrangement, the toys will be broken away in rather rigid impact or rubbing on outside of the ball and resulted in causing the water in the ball to become turbid, thus losing its original value of enjoyment which is one of its defects. In its structure, the neck of the conventional water ball is made directly in cylinder-like smooth bottle neck encased in gummed plastic sheath or wrapper. This device can prevent the running out of the clean water from the water ball though, yet after long period of saturation, the gum of the resin will lose its original viscosity; moreover, as the neck part of the water ball is of smooth surface, the clean water in the water ball will easily leak out through the crack of the degenerated gummed layer. Thus the water ball cannot keep its water content in a saturated state; meanwhile, the water leaked out through the water ball will wet part of its wooden base. The saturation will finally cause the wooden base thoroughly corroded and end the life of the entire crystall ball. This is its another defect.

One more defect is waste of time, since the entire device is combined by adhesive gum, it will take a long time after coating with the gum to finish the combination; again, in the process of production, it is unlikely to achieve the reserve perfect product. For solving the above mentioned defects of wooden and dull feeling, easily breaking away and turbid water, etc., the inventor in this case, tried hard in research and improvement, finally achieved this invention, enabling the toys in the water ball to make circular movements in turning round and round, giving a lifelike effect.

SUMMARY OF THE INVENTION

This invention is relates to the structural improvement of the motion type solid water ball, especially a kind of structure consisting of permanent magnets in combination arrangement which enables the various toys placed in the water ball to turn round and round in circular movement.

The main objective of this invention is to provide a structural improvement of motion type solid water ball by employing the combination arrangement of permanent magnets to enable the toys in the water ball to make circular movement in turning round and round, giving a life-like effect. Other objectives of this invention are to provides structural improvements of motion type solid water ball by:

(1) Pouring "Poly" resin liquid into the inside of various ceramic toys (about 30% full), then placing a transparent plastic tube with spiral teeth into the toys (one end of the plastic tube is made in square shape in order to become fixed formation with the "poly" resin) so that the plastic tube will be steadily fixed and never break away; also it will be easily passing through the central hole of the rubber cork or stopper and fixedly locking the screw nut to enable the toys permanently standing on the plate and never breaking away.

(2) Making the neck part of the glass water ball in the shape of jutting out flange, and the rubber cork or stopper with tightly fitted lip to match it so that both of them can be tightly combined together, thus the clean water in the water ball will not leak out.

(3) Using screws to fix all the combinations in the water ball (including toys and the movable upper plate; toys and the rubber cork or stopper; water ball and the base; musical bell and the battery seat, etc.) so that the combinations can be easily dismantled and changed at any time in order to achieve rapid manufacturing; thus the production capacity can be easily controlled.

For the convenience of your committee members to make further understandings of the structure, functions and objectives of this invention, detailed descriptions are as following drawings.

Figure 1:
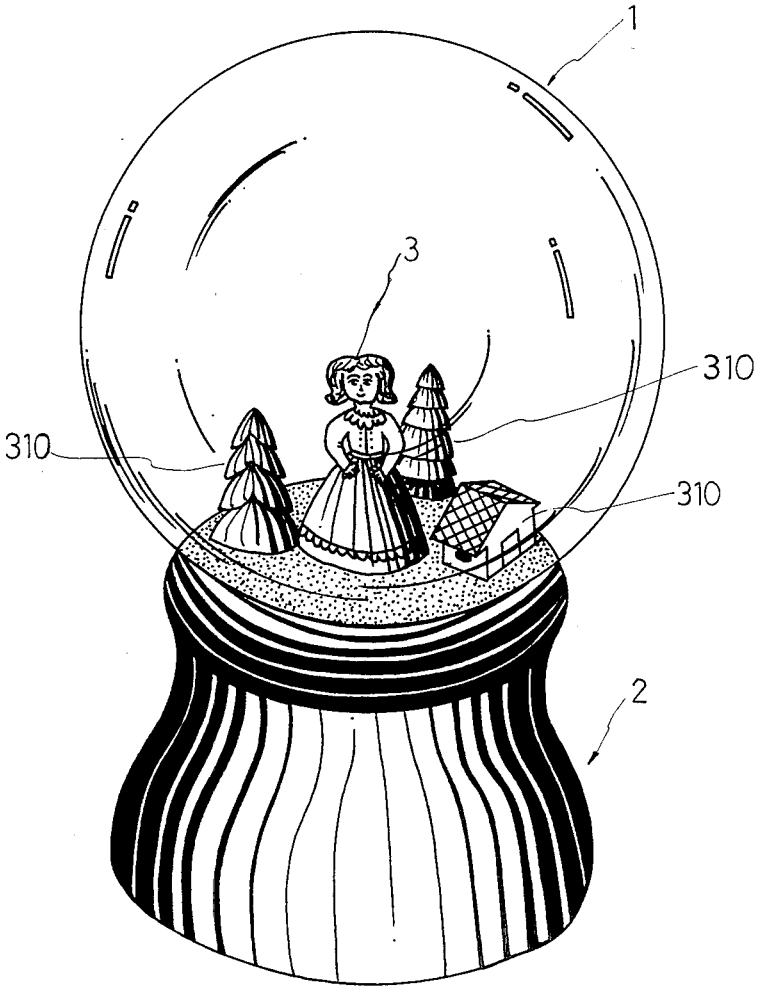
FIG. 1 is the schematic drawing of the solid combination of this invention.

As shown in FIG. 1, the outer appearance of this invention is only a glass water ball (1) base (2), and the toys (3) and (310) placed inside the water ball (1). The toys (3) and (310) can be varied in different shaped and quantities according to the requirement of the manufacture in order to achieve the variation of the overall formation.

Figure 2:
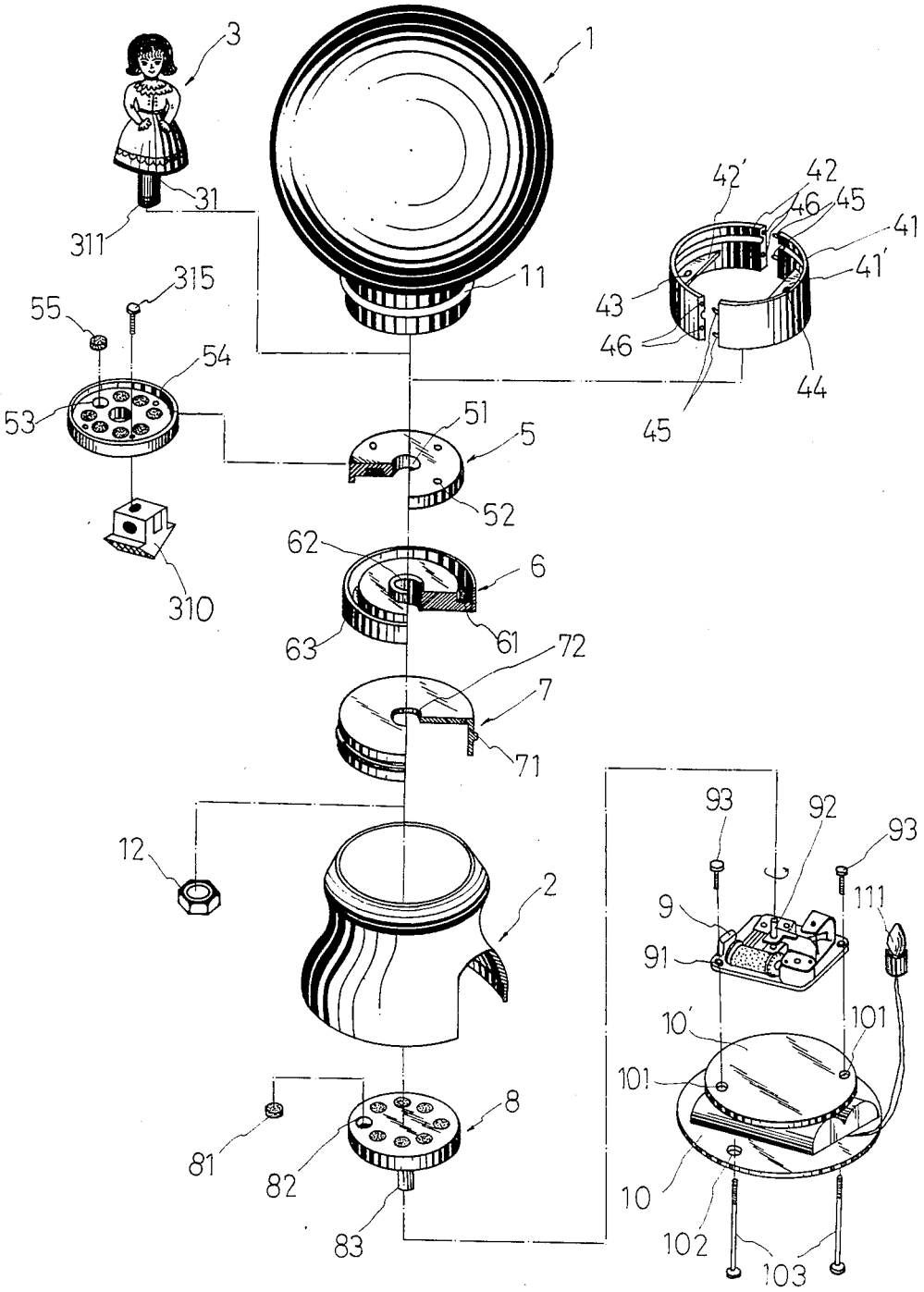
FIG. 2 is the schematic drawing of the analysis of this invention.
Figure 3:
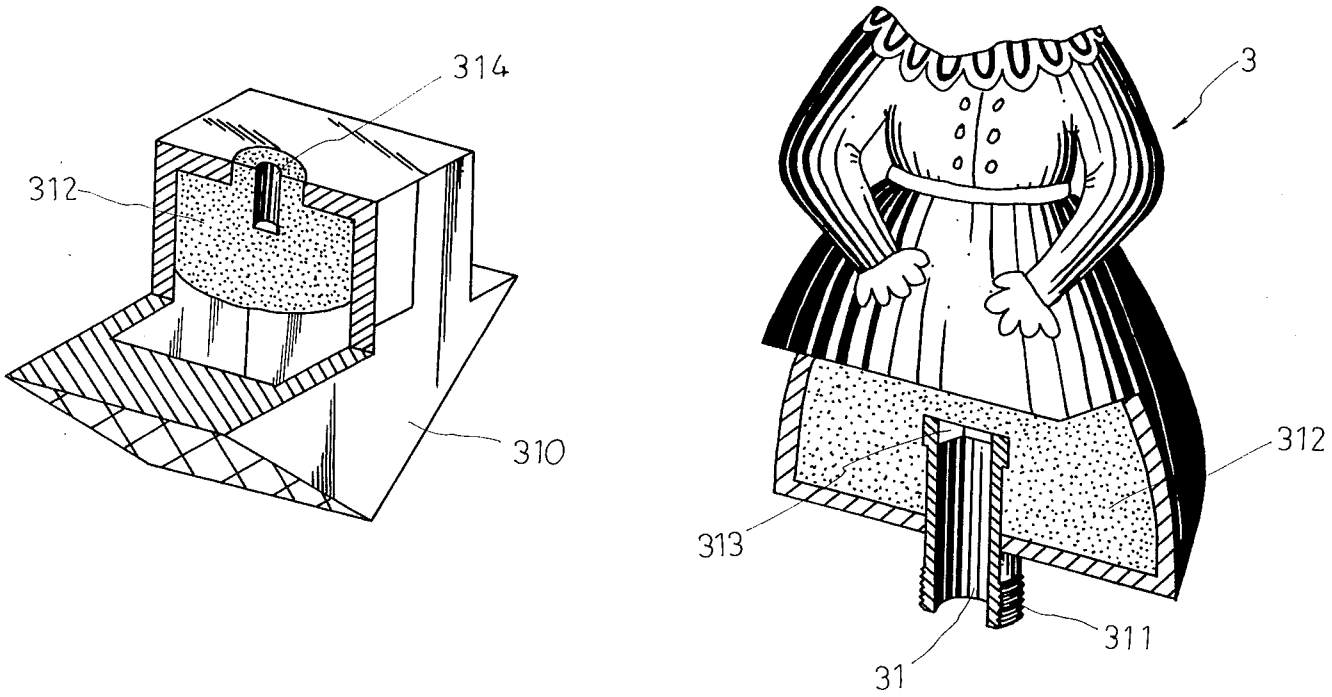
FIG. 3 is the sectional view of the doll, "poly" resin and plastic tube.

As shown in FIG. 2 the water all of this invention is formed by heating glass to the shape of a ball; and around the neck part at the bottom of the ball, there is a circle of flange (11), in such design chiefly to match each other with the tightly fitted lip (71) combined with the rubber cork or stopper (7) in order to assure the clean water in the water ball (1) not to leak out. And a sliding plate (6) and a movable plate (5) are fitted on the upper part of the rubber cork or stopper (7) (i.e., the position near the neck part of the water ball (1) after being combined together). In the center of the sliding plate (6), there is a protuberant pillar with a hole in its center for filling into the center hole (51) of the movable plate (5); after the two are filled up, a small portion (about 2–3 mm in height) of the protuberant pillar (62). Further, there is a ring shaped groove (61) around the inside of the wall (63) surrounding the sliding plate (6); it is so designed specially for the wall (54) surrounding the movable plate (5) to turn around in it. In addition, troughs (53) for storing permanent magnets (55) arranged in series are distributed separately in adequate positions inside the surrounding walls (54) of the movable plate (5)(such troughs (53) may be modified according to the different shapes of the magnets). And, at the spared positions between each magnet (55) there are screw fixing holes (52) for tightly locking the dolls and/or other toys (the number of such holes (52) may be varied according to different kinds of toys placed in the water ball). Fixed rings (41 and 42) are two semi-circular joint pieces. There are small protuberant pillar (45) at both ends of the fixed ring (41) and stud holes (46) at both ends of the fixed ring (42). When the plastic tube (31) at the bottom of the doll (3) (the bottom of the plastic tube (31) fitted with spiral teeth (311)) passes through the central hole (51) of the movable plate (5), the central hole of the sliding plate (6) and the central hole (72) of the rubber cork of stopper (7), the whole set is placed in the inside of the water ball (1). Through the mutual joining together of the tightly fitted lip (71)

combined with the rubber cork or stopper (7) and the flange (11) surrounding the neck part of the water ball (1), and through the tight joining of the fixing rings (41 and 42), it may assure the clean water in the water ball (1) not leaking out. Moreover, owing to the pressing by the bottom part of doll (3) on the upper end of salient column (62) at the center of the sliding plate (6), and the matching of tight locking with the spiral teeth (311) of the plastic tube (31) of the doll (3) by the screw nut (12), this may assure the sliding plate (6) not wafting upwards and downwards or leftwise and rightwise. The fixed rings (41 and 42) are made in whole pieces formation, with a set of semi-circular extending plates (41' and 42'), each having a screw hole (43 and 44) respectively. The base (2) is a foundation of wooden material (or of other suitable materials), with a battery set (10), music bell (9) and fixed plate (8) in its interior space. There is a hollow protuberant pillar (83) in the bottom center of the fixed plate (8), chiefly for the special purpose of encasing the driving pole (92) of the music bell (9). Also through (82) for storing permanent magnets (81) are fitted in adequate position on the fixed plate (8); the serial arrangement of troughs (82) are contrast to those to those magnets troughs (53) of movable plate (5). The device of music bell (9) is fixed with screws (93) in the screw holes (101) on the fixed plate (10') at the upper end of the battery set (10); and both ends of its base are also fitted with screw holes (102) through which the long screws may be fixed upward in the screw holes (43 and 44) fitted on the extending plate of the fixed rings (41 and 42) so that the music bell (9) will be steadily locked without any chance of breaking away. It is only necessary to remove the long screw (103) if the water ball (1) should be dismantled from the base (2). The electric power source for lighting the electric bulb (111) is from the battery set (10). The connection may be passing through the crevice between the fixed plate (8) and the rubber cork or stopper (71) (the portion of electric wire may be fitted on the inside wall of the rubber cork (7)); and this whole device is placed in the plastic tube (31) at the lower end of the doll (3). When the electric power source of the battery set is turned on, the bulb (111) will be lighted through the doll (3), enabling the entire water ball (1) to glisten brightly in the night like a brilliant treasuring pearl. When the whole system is combined, with the switch of the music bell (9) started on, the driving pole (92) will drive the fixed plate (8) into motion; and further through the permanent magnets (81) arranged in serial combination on the fixed plate (8) to induce the permanent magnets (55) fitted at the lower end of the movable plate (5) into movement of turning round and round so that the toys (310) fitted on the movable plate (5) to make variable actions, giving feelings of life-like effects. Moreover, the arrangements in polarized directions of the permanent magnets (55) fitted on the movable upper plate (5) and the permanent magnets (81) fitted on the fixed lower plate (8) may be mutually attracted or mutually repelled each other; the difference between the two lines only in the difference of the speeds of revolutions.)

Besides, toys (3 and 310) are all made of ceramics. Their hollow insides are filled with "poly" resin liquid (312). As the doll (3) is filled with "poly" resin (312), a plastic tube (31) is inserted to the doll's body. One end of the plastic tube (31) is in square shape (313); the chief purpose of forming in square shape is to make the plastic tube to combine with "poly" resin and turn into condensed formation so that it can be permanently fixed, never breaking away. And, after the toy (310) being condensed with the "poly", a small hole (314) is drilled in its center so that the screw (315) can be securely locked in order to achieve the purpose of being securely fixed. In conclusion, it is evident that this invention is utilizing the familiar theory of mutual attraction and mutual repelling of the magnets, yet it has certainly enable the toys inside the conventional water ball to turn into active status from stationary status. It is really a great breakthrough of the overall status. It is really a great breakthrough of the overall structure. Furthermore, such device has neither appeared in the domestic or foreign magazines, nor prevailed on the market. (Hence, it is certainly eligible to apply for patent rights. For this reason, we legitimately present this application to your committee for patent of this invention. Your kind attention and timely action of reviewing and screening this invention and granting the derserved rights will be immensely appreciated.)

We claim:

1. A water ball mechanism having a base member and an outer substantially transparent housing containing a figure adapted for rotative displacement comprising:
   (a) rotational drive means fixedly secured to said base member, said rotational drive means having a drive pole member being rotationally displaced;
   (b) a fixed plate member secured to said drive pole member, said fixed plate member having a first set of permanent magnets mounted therein;
   (c) a sliding plate vertically aligned with respect to said fixed plate and being rotationally displaceable, said sliding plate having a ring shaped groove formed within an upper end thereof;
   (d) a movable plate having a downwardly extending flange inserted within said ring shaped groove of said sliding plate, said movable plate being rotationally displaceable with respect to said sliding plate, said movable plate having a second set of permanent magnets mounted in a lower end section thereof for magnetic coupling with said first set of magnets mounted within said fixed plate; and,
   (e) a tubular member fixedly secured to a lower end portion of said figure and extending through a plurality of central through openings formed in said movable plate and said sliding plate, said tubular member being threadedly secured to a coupling nut member.

2. The water ball mechanism as recited in claim 1 including a fluidly impermeable stopper member interposed between said base member and said sliding plate, said tubular member extending through a central opening formed in said stopper member.

3. The water ball mechanism as recited in claim 1 including at least a second figure fixedly secured to said movable plate.

4. The water ball mechanism as recited in claim 3 where said second figure includes a substantially hollow internal chamber having poly resin inserted therein, said poly resin having a hole drilled therein for insert of a screw member for securing said second figure to said movable plate.

5. The water ball mechanism as recited in claim 1 including a plurality of figures mounted to an upper portion of said movable plate.

6. The water ball mechanism as recited in claim 1 wherein said first and second sets of permanent magnets include varying contour shapes.

7. The water ball mechanism as recited in claim 1 including a pair of fixed ring members of cross-sectional semi-circular contour, one of said fixed ring members having stud members insertable within holes formed in the other of said fixed ring members.

* * * * *